US007819777B1

(12) United States Patent
Service

(10) Patent No.: US 7,819,777 B1
(45) Date of Patent: Oct. 26, 2010

(54) EXERCISE ALIGNMENT MAT SYSTEM

(75) Inventor: Patrick W. Service, Butner, NC (US)

(73) Assignee: Youtrainfitness, LLC, Butner, NC (US)

( * ) Notice: Subject to any disclaimer, the term of this patent is extended or adjusted under 35 U.S.C. 154(b) by 0 days.

(21) Appl. No.: 12/469,941

(22) Filed: May 21, 2009

(51) Int. Cl.
*A63B 26/00* (2006.01)

(52) U.S. Cl. ..... 482/23; 482/140; 482/907

(58) Field of Classification Search ..... 482/23, 482/140, 91, 148, 908, 141, 139, 35–37, 482/39, 41, 79, 907; 5/417, 420, 500; D06/582, D06/613; 52/660; D12/203
See application file for complete search history.

(56) References Cited

U.S. PATENT DOCUMENTS 3,016,317 A * 1/1962 Brunner ..... 428/138
5,071,130 A * 12/1991 Shofner ..... 473/218
5,360,653 A * 11/1994 Ackley ..... 428/71
6,387,013 B1 5/2002 Marquez
6,723,004 B1 4/2004 Florian
6,737,150 B2 * 5/2004 Zahler et al. ..... 428/156
2004/0214692 A1 * 10/2004 Koenig ..... 482/23
2004/0229731 A1 11/2004 Mitchell
2007/0275827 A1 * 11/2007 Glaser ..... 482/23
2008/0096183 A1 * 4/2008 Cotran et al. ..... 434/428

* cited by examiner

*Primary Examiner*—Lori Baker
(74) *Attorney, Agent, or Firm*—Charter IP, LLC; Matthew J. Lattig

(57) ABSTRACT

An exercise alignment mat system for performing various exercises includes a mat of a generally flat structure having a top surface, bottom surface and a thickness, a major longitudinal axis and a minor longitudinal axis orthogonal to the major longitudinal axis, and a plurality of spaced grooves formed in the top surface along both the major and minor axes so as to define a plurality of equal sized panels on the mat. Each panel includes a set of concentric squares indicia thereon, in which an upper half of each square in the concentric squares has a dotted line configuration for fingertip placement, and a lower half of each square has a solid line configuration for palm placement.

27 Claims, 4 Drawing Sheets

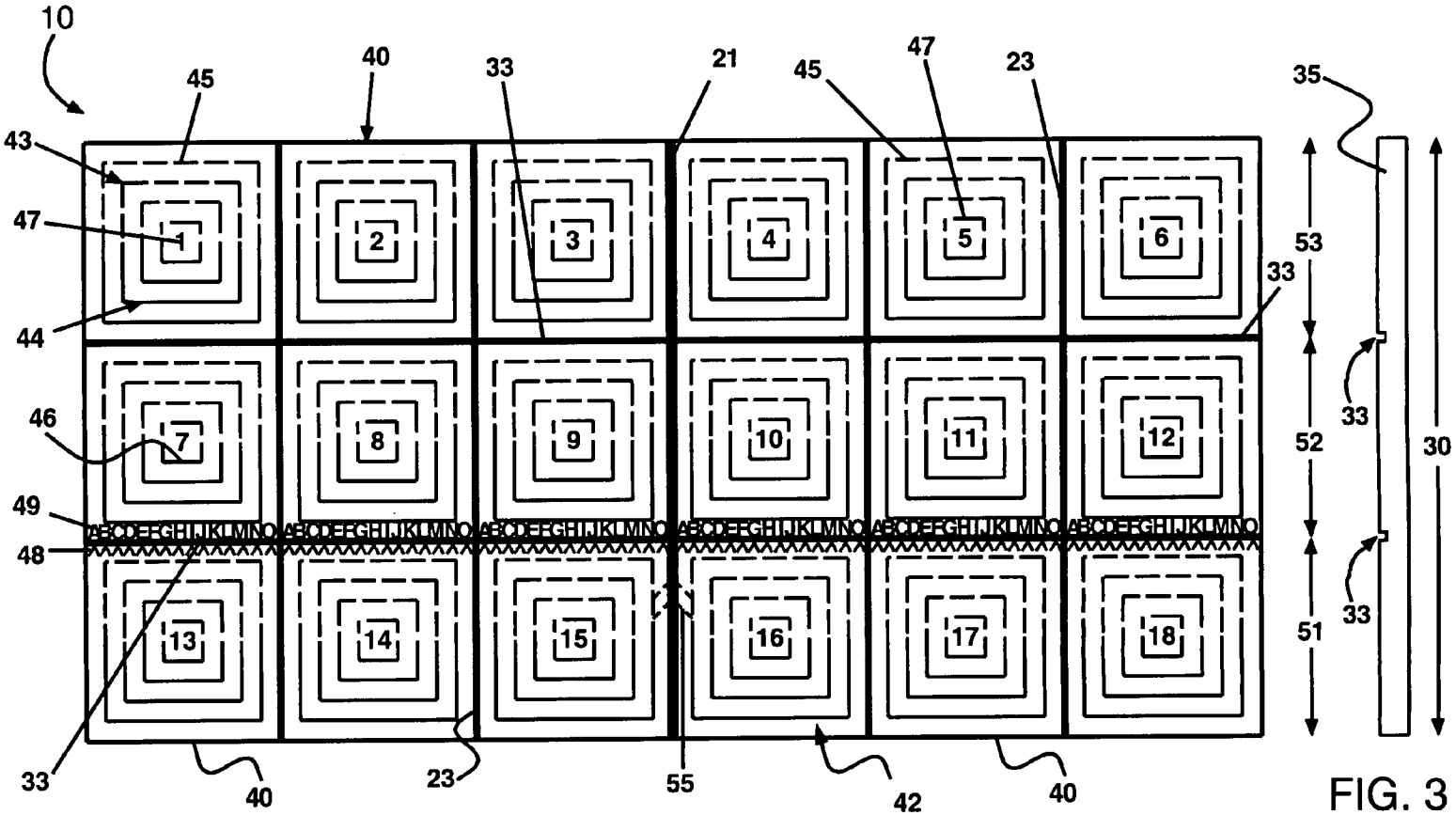
FIG. 2
FIG. 3
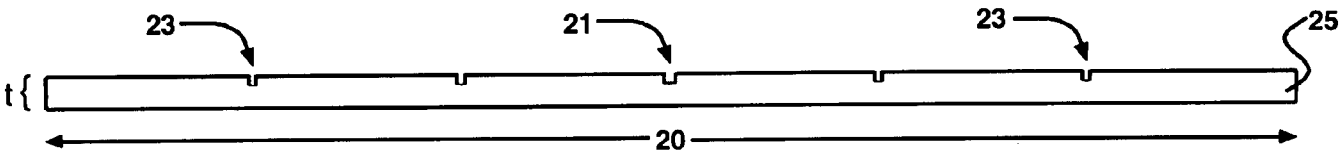
FIG. 4

EXERCISE ALIGNMENT MAT SYSTEM

BACKGROUND

1. Field

Example embodiments in general are directed to an exercise alignment mat system having indicia and formed grooves therein for facilitating various exercises including push-up exercises.

2. Related Art

Exercise mats have been in use for years. A conventional exercise mat is comprised of a flat structure and typically constructed of a foam rubber material. Most conventional mats have a rectangular shape. Typically these mats do not have indicia thereon, although there are mat systems with indicia thereon to assist one performing yoga exercises, and/or to help perfect posture and orientation of the feet for a golf swing, for example. While these mat systems may be suitable for the particular purpose to which the system addresses, these systems are not as suitable for providing reference to an individual performing an exercise such as a push-up.

The stationary push-up (or press-up) exercise is regarded as an effective exercise for strengthening the upper body muscles (i.e., chest, shoulders, and triceps). The stationary push-up supports approximately 65% of a person's body weight from the start position and 75% of the person's weight when their arms are parallel to the floor, pressing their body upward. Incorporating the use of the staggered push-up further strengthens the abdominal (core) region. Mobile push-ups (press-ups) are more challenging because periods exist where the person's body weight is supported by one hand (e.g., when moving one hand to another area after the push-up (press-up)). Repeated moves between hands increase fatigue.

Certain push-up exercise devices (handles, basic mat) offer limited opportunities for individuals to perform varied push-up exercises. These devices typically can be used to perform a push-up exercise occurring on a stationary horizontal plane. Neither these devices nor the conventional mat systems provide visual guidance and/or hand alignment, to the user, for performing push-up exercises such as stationary, staggered and mobile push-ups.

SUMMARY

An example embodiment of the present invention is directed to an exercise alignment mat system. The system includes a mat of a generally flat structure having a top surface, bottom surface and a thickness, a major longitudinal axis and a minor longitudinal axis orthogonal to the major longitudinal axis. The system includes a central groove formed in the top surface and having a first width, the central groove extending along the minor axis so as to bisect the mat, a first set of equally spaced grooves formed in the top surface and having a second width less than the first width, and a second set of equally spaced grooves formed in the top surface and equal in width to the first set of grooves. The first set of grooves extends along the minor axis parallel to the central groove, and the second set of grooves extends along the major axis orthogonal to the central groove. Intersections of the central groove, first set and second set of grooves define a plurality of equal sized panels, where each panel includes a set of concentric squares indicia thereon to facilitate hand placements for exercise.

Another example embodiment is directed to an exercise alignment mat system that includes a mat of a generally flat structure having a top surface, bottom surface and a thickness, a major longitudinal axis and a minor longitudinal axis orthogonal to the major longitudinal axis, and which includes a plurality of spaced grooves formed in the top surface along both the major and minor axes so as to define a plurality of equal sized panels on the mat. Each panel includes a set of concentric squares indicia thereon, in which an upper half of each square in the concentric squares has a dotted line configuration for fingertip placement, and a lower half of each square has a solid line configuration for palm placement.

Another example embodiment is directed to an exercise alignment mat system that includes a mat of a generally flat structure having a top surface, bottom surface and a thickness, a major longitudinal axis and a minor longitudinal axis orthogonal to the major longitudinal axis, and a plurality of spaced grooves formed in the top surface along both the major and minor axes so as to define a plurality of equal-sized panels arranged in rows on the mat. A plurality of grooved notches are formed which extend along the major axis of the mat across the top of a row of panels. The grooved notches provide a tactile reference for a finger tip of a user's middle finger to facilitate hand placements for exercise.

Another example embodiment is directed to an exercise alignment mat system that includes a mat of a generally flat structure having a top surface, bottom surface and a thickness, a major longitudinal axis and a minor longitudinal axis orthogonal to the major longitudinal axis, and a plurality of spaced grooves formed in the top surface along both the major and minor axes so as to define a plurality of equal-sized panels arranged in rows on the mat. The system includes a plurality of lettering sequences repeating in each panel of one of the rows to provide a visual reference for a finger tip of a user's middle finger to facilitate hand placements for exercise.

Another example embodiment is directed to an exercise alignment mat system that includes a mat of a generally flat structure having a top surface, bottom surface and a thickness, a major longitudinal axis and a minor longitudinal axis orthogonal to the major longitudinal axis, and a plurality of spaced grooves formed in the top surface along both the major and minor axes so as to define a plurality of equal sized panels arranged in rows on the mat. Each panel includes a set of concentric squares indicia thereon, a first pair of spaced, upwardly angled lines extending from a largest square of the concentric squares within a first panel, and a second pair of spaced, upwardly angled lines extending from a largest square of the concentric squares within a second panel that adjoins the first panel. The second pair of angles lines is angled in mirror image relation to the first pair. The concentric squares, first pair and second pair of angled lines serve as a visual reference for index finger placement of each hand of a user for exercise.

Another example embodiment is directed to an exercise alignment mat system that includes a plurality of separate and generally square panels, in which each panel has a generally flat structure with a top surface, bottom surface and a thickness. Each panel includes a set of concentric squares indicia thereon, in which the upper half of each square in the concentric squares has a dotted line configuration for fingertip placement, and the lower half has a solid line configuration for palm placement.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

FIG. 2 is a top plan view of the mat system of FIG. 1.

FIG. 3 is a front plan view of the mat system of FIG. 1.

FIG. 4 is a side view of the mat system of FIG. 1.

DETAILED DESCRIPTION

As to be described in detail hereafter, the example exercise alignment mat system, in addition to enabling a user to perform a conventional push-up on a stationary horizontal plane, provides an opportunity to perform the push-up exercise longitudinally and diagonally, while the user's hands are stationary or mobile. Moreover, the mat system makes it possible for a user to perform a push-up routine that involves hand placement at an equidistant, via a plurality of indicia printed thereon and/or grooves formed therein.

Referring now to FIGS. 1 to 5, there is described an exercise alignment mat system 10 that through visual and kinesthetic hand placements may help the user to execute various push-up (press-up) exercises with greater versatility than conventional mats or exercise devices. The mat system 10 includes a generally rectangular mat 11 with a plurality of references and/or markings thereon and grooves therein to facilitate placement of the hands for various exercises. The mat 11 has an upper or top surface and a lower or bottom surface. In an example, the mat 11 can be fabricated from a suitable foam rubber such as ethylene vinyl acetate (EVA) foam. The EVA foam may include an antimicrobial agent therein or can include a thin antimicrobial material adhered to on a surface thereof, for example. Additional example materials for mat 11 may be any material used in commercially available anti-fatigue exercise mat products.

Figure 1:
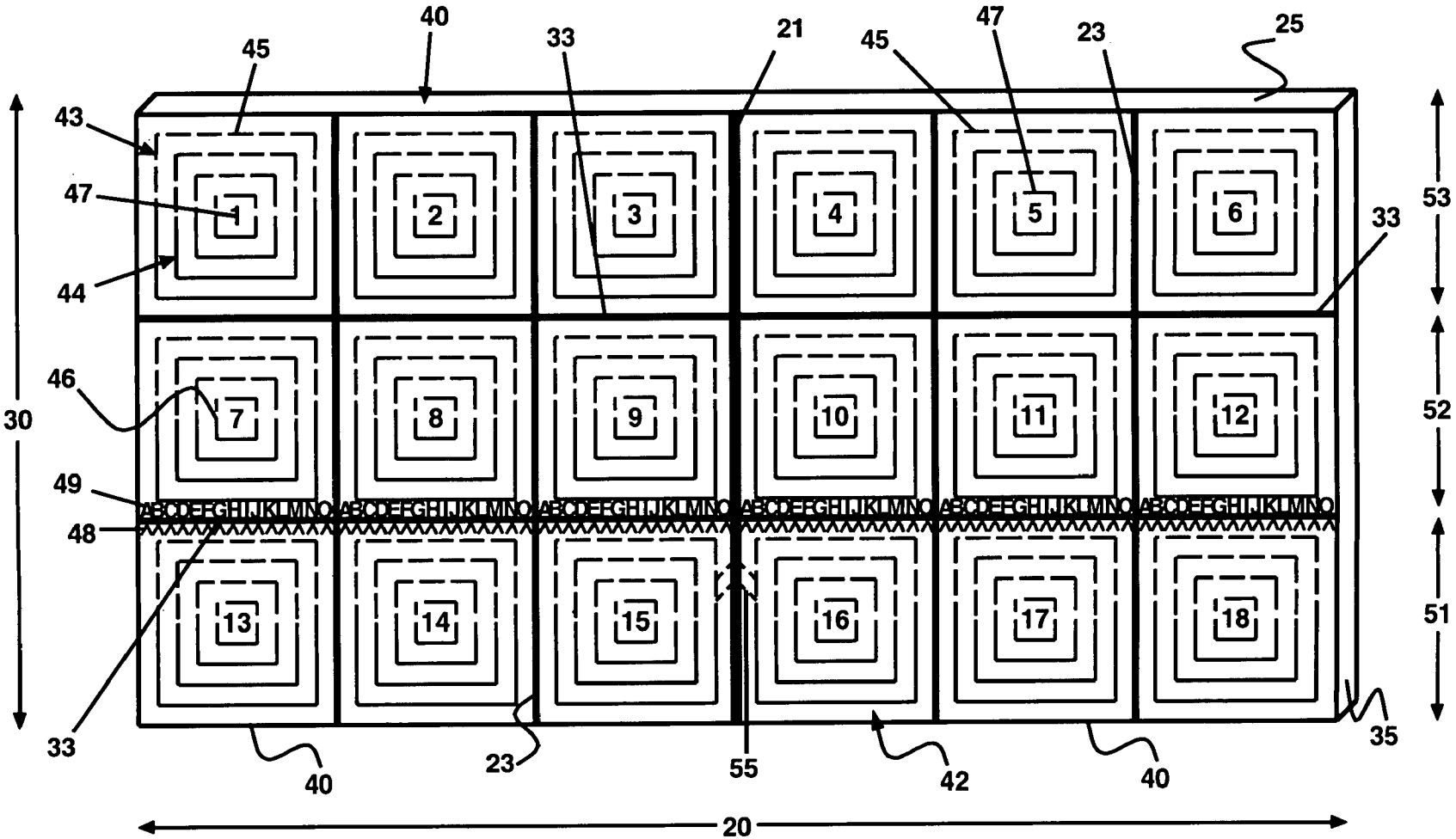
FIG. 1 is a perspective view of an exercise alignment mat system in accordance with an example embodiment.

The mat 11 has a major longitudinal axis 20 ("major axis 20"), a minor longitudinal axis ("minor axis 30") orthogonal to the major axis 20, and a thickness, shown by major axis sidewall 25 and minor axis sidewall 35. A series of grooves are formed into the top surface of mat 11. For example, there is provided a central groove 21 extending along the minor axis 30 so as to bisect the mat 11. The central groove 21 is wider than a series of parallel and spaced grooves 23 that extend on either side of the central groove 21 along the minor axis 30. A pair of spaced grooves 33 is formed in the mat 11, extending along the major axis 20 as shown in FIGS. 1 and 2. The arrangement of grooves 21, 23 and 33 define a plurality of equal-sized panels 40 on the mat 11. Each panel 40 is numbered to define a unit; as shown in this example there are eighteen (18) total panels 40, or three levels of 6 panels. The levels are shown as a base level 51, a middle level 52 and an upper level 53. The panels 40 in these levels 51, 52, 53 may be used to perform various push-up exercises, as to be described in more detail hereafter.

Each panel 40 has a plurality of indicia thereon shown as concentric squares (shown generally by arrow 42). Starting with the largest outer square 45, the upper half of each square has a dotted line configuration 43 for its upper half, and a solid line configuration 44 for its lower half. The smallest central square 46 in each panel 40 has numeric indicia 47 therein. The numbers 47 may be used to place hands on for different exercise routines, as to be described in more detail hereafter. The dotted lines 43 of each of the concentric squares 42 provide visual guidance to the user as to where to place their fingertips. The solid lines 44 indicate where the user should place their palm, so as to properly align the hand on a given panel 40 prior to an impending exercise repetition.

A series of grooved notches 48 are formed across the top of each panel 40 in the base level 51. Additionally, a series of sequential letters (A-O) 49 are printed across the bottom of each panel 40 in the middle level 52. The user can place his/her middle finger-tip in one of the grooved notches 48. The notches 48 provide a secure reference to perform each push-up (press-up) exercise at a desired or proper equidistant. Alternatively, the user can use the letters 49 for consistent proper placement of fingertips on the mat 11 between sets of repetitions. The letters 49 thus serve as an additional reference to help the user to remember finger-tip positions.

The outer square 45 in the panels 40 that are numbered 15 and 16 include a pair of spaced, diagonal or angled lines 55. The angled lines 55 are provided to guide index finger placement for doing a "diamond push-up" exercise. In an example, the angled lines 55 are less than 2 inches apart from the central groove 21.

In one example, the dimensions of the mat 11 may be 72" along the major axis 20 and 36" along the minor axis 30, although various sizes are evident to one skilled in the art, such as 48"×36", for example. As shown in FIGS. 3 and 4, the mat 11 may have a thickness t of about 0.5 inches. The depths of each of the central groove 21 and grooves 23 and 33 may be about 0.25 inches for example.

Figure 5:
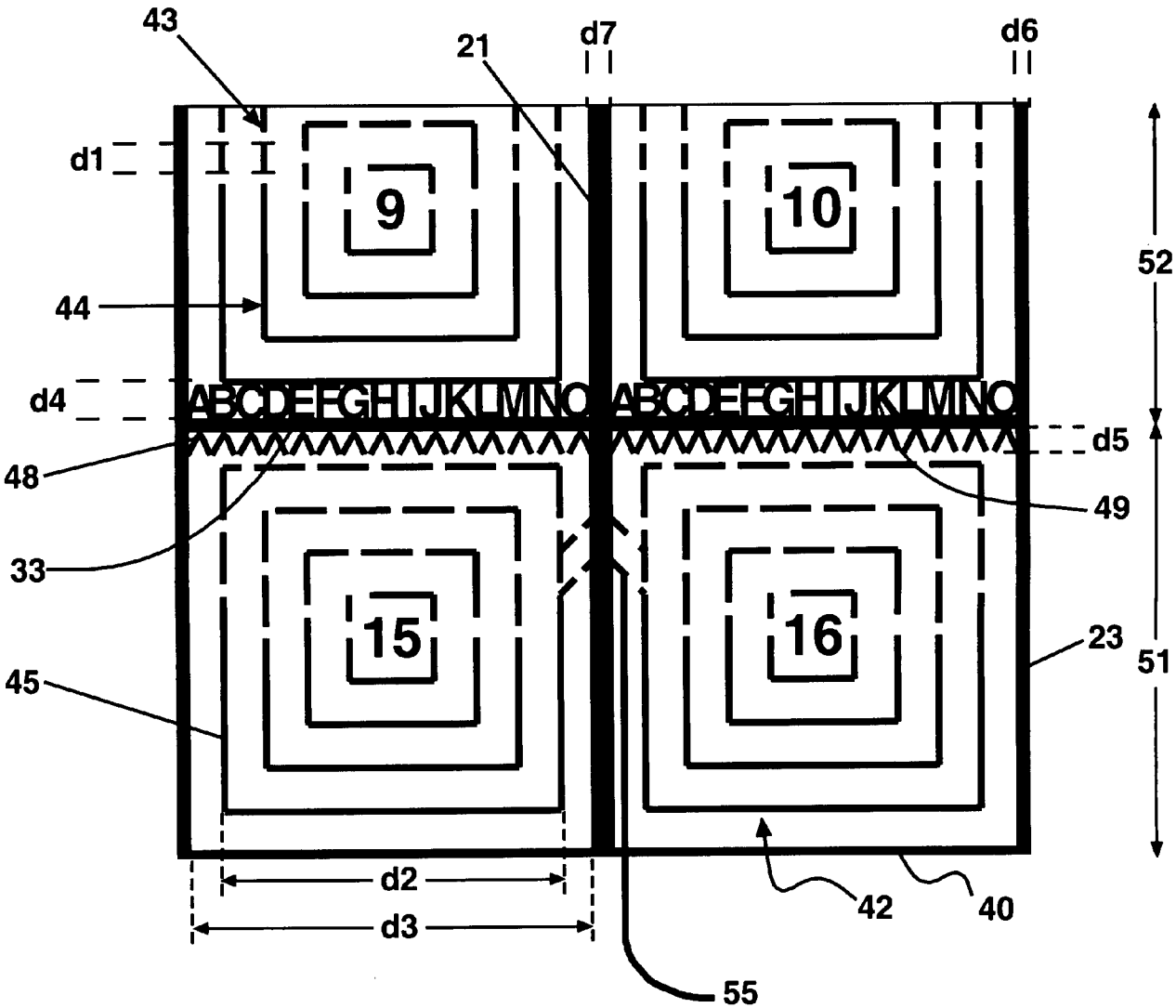
FIG. 5 is an enlarged view of a portion of the mat system of FIG. 1 to illustrate references and markings on the mat in more detail.

Referring to FIG. 5, the length d1 of each dashed line 43 may be about 1.5 inches or less. The maximum length d2 of a solid line 44 on a side in the concentric squares 42 is about 10 inches. The length (or width) d3 of a panel 40 may be about 11.75 inches. The height (or width) of each letter 49 (d4) and each grooved notch 48 (d5) is approximately 0.75 inches or less. Each of the grooves 23, 33 may have a width d6 of about 0.25 inches. The central groove 21 may have a width d7 of about 0.5 inches.

The mat system 10 provides a number of functions for the user. First, the mat system 10 enables the user to perform various common position push-up (press-up) exercises while the user's hands maintain these positions. Second, the mat system 10 enables the user to place his/her middle finger-tip in the grooved notches 48 (on the panels 40 of base level 51). The notches 48 provide a secure reference to perform each push-up (press-up) exercise at a desired or proper equidistant. Third, the user may perform various push-up exercises with hand positions split between combinations of the base level 51, middle level 52 and upper level 53.

Examples of the various common position push-up (press-up) exercises that can be performed by the user on the base level 51 of the mat system 10 include diamond push-ups, close-width push-ups, shoulder-width push-ups, wide-width push-ups, and widest-width push-ups. Referring to FIG. 2, for a diamond push-up, the left index finger can be placed on the panel 40 numbered "15" and diagonally aligned with the dashed lines 55 touching the center groove 21. Similarly, the right index finger is placed on the panel 40 numbered "16" and diagonally aligned with the dashed lines 55 touching the center groove 21, such that the tips of the index fingers touch For close-width push-ups, the left hand is placed towards the center of the panel 40 numbered "15" and the right hand is placed towards the center of the panel 40 numbered "16". For shoulder-width push-ups, the left hand is placed towards the outer part of the panel 40 numbered "15" and the right hand is placed towards the outer part of the panel 40 numbered "16". For wide-width push-ups, the left hand is placed towards the inner part of the panel 40 numbered "14" and the right hand is placed towards the inner part of the panel 40 numbered "17". For widest-width push-ups, the left hand is placed towards the center of the panel 40 numbered "14" and the right hand is placed towards the center of the panel 40 numbered "17".

The user may of course adjust his/her hands to a width that's more comfortable for him/her. The positions of close width, shoulder width, wide width, and widest width are examples only. Further, the user may align hand positions with the dashed horizontal lines 43 of the concentric squares 42 for visual reference. This helps to ensure that both left and right hands are at an equidistant, providing some level of precision.

To achieve greater precision, the user may employ the notched grooves 48 across the top of the panels 40 in base level 51. This may provide a secure reference for performing each push-up (press-up) exercise at an equidistant. Additionally, the letters 49 across the bottom of the panels 40 in the middle level 52 may be used as an additional reference to help user to remember finger-tip positions (e.g., 15B and 16N may be a position preference of the user wishing to complete 2 sets of 10 repetitions). After the user completes the first set of 10 repetitions, the user may rest briefly in an alternate position, then return to complete another set of 10 repetitions. Because the user is aware of his/her finger positions from the first set, they can be assured of the correct finger placement and arm width for the second set.

Moreover, the grooved notches 48 enable the user to essentially "immobilize" the middle finger tip. This helps to keep the other fingers firmly positioned on the mat system 10. Additionally, the grooved notches 48 may aid persons who are visually impaired and/or who cannot clearly see the lettering 49.

As noted, the user may also perform various push-up exercises with hand positions split between one or more of the base level 51, middle level 52 and upper level 53. Example push-up exercises include stationary, mobile horizontal, staggered, stationary staggered diagonal, stationary staggered longitudinal mobile and staggered diagonal mobile push-ups. The user may also perform any combination of stationary, longitudinal, horizontal and diagonal mobile patterns of interest.

For the purpose of the following example exercises, when the term stationary is used, the arm movement is vertical (up and down), while the hand stays firmly positioned on the numbered panel 40. Additionally, the term mobile is used to describe where the arm movement is vertical (up and down), while the hand moves from one panel 40 to another longitudinally, horizontally, and/or diagonally. For the following examples, hand placement on panels 40 that are numbered 1, 2, 3, 7, 8, 9, 13, 14 and 15 is performed with the left hand; hand placement on panels 40 that are numbered 4, 5, 6, 10, 11, 12, 16, 17 and 18 is performed with the right hand.

For ease of reference below, a specific panel 40 is referred to by a numbered "unit" in square 47. Examples 1-4 are directed to exercises performed with both hands on panels 40 of the base level 51. Examples 5-9 are directed to exercises performed with one hand on a panel 40 in base level 51, the other hand on a panel 40 in middle level 52. Examples 10-15 are directed to exercises performed with hands being repositioned between panels 40 on each of the base level 51, middle level 52 and upper level 53.

Example 1

Stationary left, mobile right. Left hand is placed towards the center of unit 15 while right hand is placed towards the center of unit 16. After one repetition (push-up), the user moves his/her right hand horizontally towards the center of unit 17 for another repetition. The user then returns his/her right hand horizontally towards the center of unit 16 for another repetition. Total repetitions performed during this example exercise are 3.

Example 2

Stationary right, mobile left. Left hand is placed towards the center of unit 15 while right hand is placed towards the center of unit 16. After one repetition (push-up), the user then moves his/her left hand horizontally towards the center of unit 14 for another repetition. The user then returns his/her left hand horizontally towards the center of unit 15 for another repetition. Total repetitions performed during this example exercise are 3.

Example 3

Alternate left and right mobile. Left hand is placed towards the center of unit 15 while right hand is placed towards the center of unit 16. After one repetition (push-up), the user moves his/her right hand horizontally towards the center of unit 17 for another repetition. The user then returns his/her right hand horizontally towards the center of unit 16 for another repetition. Next the user places his/her left hand horizontally towards the center of unit 14 for one repetition. Next the user returns his/her left hand horizontally towards the center on unit 15 for a final repetition. Total repetitions performed during this example exercise are 5.

Example 4

Mobile jump (Plyometrics type). Left hand is placed towards the center of unit 15 while right hand is placed towards the center of unit 16. The user lowers chest towards the mat 11 approximately halfway and then abruptly pushes up, extending hands horizontally in the air then landing with left hand towards the center of unit 14 and right hand towards unit 17 simultaneously. The user then lowers chest towards the mat 11 approximately halfway and then abruptly pushes up, extending hands horizontally in the air now landing with left hand towards the center towards unit 15 and right hand towards unit 16 simultaneously. Total repetitions performed during this example exercise are 2.

Example 5

Staggered stationary. Left hand is placed towards the center of unit 15 while right hand is placed towards the center of unit 10. User lowers his/her chest about halfway, and then returns to starting position. One repetition is performed during this example exercise.

Example 6

Staggered diagonal stationary. Left hand is placed towards the center of unit 15 while right hand is placed diagonally towards the center of unit 11. User lowers his/her chest about halfway, and then returns to starting position. One repetition performed during this example exercise.

Example 7

Staggered longitudinal mobile. Left hand is placed towards the center of unit 15 while right hand is placed towards the center of unit 16. After one repetition (push-up), the user moves his/her right hand longitudinally towards the center of unit 10 for another repetition. The user then returns his/her right hand longitudinally towards the center of unit 16 for another repetition. The user then places his/her left hand longitudinally towards the center of unit 9 for another repetition. The user then returns his/her left hand longitudinally towards the center of unit 15 for the final repetition. Total repetitions performed during this example exercise are 5.

Example 8

Staggered diagonal mobile. Left hand is placed towards the center of unit 15 while right hand is placed towards the center of unit 16. After one repetition (push-up), the user moves his/her right hand diagonally towards the center of unit 11 for another repetition. The user then returns his/her right hand diagonally towards the center of unit 16 for another repetition. The user then places his/her left hand diagonally towards the center of unit 8 for another repetition. The user then returns his/her left hand diagonally towards the center of unit 15 for the final repetition. Total repetitions performed during this example exercise are 5.

Example 9

Staggered diagonal, longitudinal, horizontal mobile combination. Left hand is placed towards the center of unit 15 while right hand is place towards the center of unit 16. After one repetition (push-up), the user moves his/her right hand diagonally towards the center of unit 11 for another repetition. The user then moves his/her right hand longitudinally towards the center of unit 17 to perform another repetition. The user then returns his/her right hand horizontally towards the center of unit 16 for another repetition. The user then places his/her left hand diagonally towards the center of unit 8 for another repetition. The user then moves his/her hand longitudinally towards the center of unit 14 for another repetition. The user then returns his/her left hand horizontally towards the center of unit 15 for the final repetition Total repetitions performed during this example exercise are 7.

Example 10

Staggered stationary. Left hand is placed towards the center of unit 15 while right hand is placed towards the center of unit 4. User lowers his/her chest about halfway, and then returns chest to starting position. One repetition is performed during this example exercise.

Example 11

Staggered diagonal stationary. Left hand is placed towards the center of unit 15 while right hand is placed towards the center of unit 5. User lowers his/her chest about halfway, and then returns to starting position. One repetition performed during this example exercise.

Example 12

Staggered longitudinal mobile. Left hand is placed towards the center of unit 15 while right hand is placed towards the center of unit 16. After one repetition (push-up), the user moves his/her right hand longitudinally towards the center of unit 4 for another repetition. The user then returns his/her right hand longitudinally towards the center of unit 16 for another repetition. The user then places his/her left hand longitudinally towards the center of unit 3 for another repetition. The user then returns his/her left hands longitudinally towards the center of unit 15 for the final repetition. Total repetitions performed during this exercise example are 5.

Example 13

Staggered diagonal mobile. Left hand is placed towards the center of unit 15 while right hand is placed towards the center of unit 16. After one repetition (push-up), the user moves his/her right hand diagonally towards the center of unit 6 for another repetition. The user then returns his/her right hand diagonally towards the center of unit 16 for another repetition. The user then places his/her left hand diagonally towards the center of unit 1 for another repetition. The user then returns his/her left hand diagonally towards the center of unit 15 for the final repetition. Total repetitions performed during this exercise example are 5.

Example 14

Staggered diagonal, longitudinal, horizontal mobile combination. Left hand is placed towards the center of unit 15 while right hand is placed towards the center of unit 16. After one repetition (push-up), the user moves his/her right hand diagonally towards the center of unit 5 for another repetition. The user then moves his/her right hand longitudinally towards the center of unit 17 to perform another repetition. The user then returns his/her right hand horizontally towards the center of unit 16 for another repetition. The user then places left hand diagonally towards the center of unit for another repetition. The user then moves his/her left hand longitudinally towards the center of unit 14 for another repetition. The user then returns his/her left hand horizontally towards the center of unit 15 for the final repetition. Total repetitions performed during this example exercise are 7.

Example 15

Staggered diagonal, longitudinal, horizontal mobile combination (base, middle and upper Level). Left hand is placed towards the center of unit 15 while right hand is placed towards the center of unit 16. After one repetition (push-up), the user moves his/her right hand diagonally towards the center of unit 11 for another repetition. The user then moves his/her right hand longitudinally towards the center of unit 5 to perform another repetition. The user then moves his/her right hand horizontally to unit 6 for another repetition. The user then returns his/her right hand diagonally towards the center of unit 16 for another repetition. The user then moves his/her left hand diagonally towards the center of unit 8 for another repetition. The user then moves his/her left hand longitudinal towards the center of unit 2 for another repetition. The user then moves his/her left hand horizontally to unit 1 for another repetition. The user then returns his/her left hand diagonally towards the center of unit 15 for the final repetition. Total repetitions performed during this example exercise are 9.

The mat system 10 enables the user to perform a push-up with greater accuracy in terms of the measurement (distance) between the hands for various hand positions. The map system 10 provides a guide for the user on hand locations based on a predetermined pattern or on their choice of hand placement. The mat system 10 thus functions as an upper body exercise system for the chest, shoulders, core, and triceps muscles, as it makes it possible for the user to perform many push-up variations with confidence.

The mat system 10 has no moving parts, is composed of a relatively sturdy foam rubber material, and is reasonably simple to use, with easy to read diagrams. The grooved notches may assist hand alignment for users including persons who are visually impaired.

Therefore, the example mat system 10, through visual and kinesthetic hand placements, may help the user to execute various push-up (press-up) exercises with greater versatility than conventional mats or exercise devices. The system 10's incorporation of numbered panels 40, where each panel 40 includes concentric squares 42 having dotted line indicia 43 and solid line indicia 44, provides for accurate finger tip and palm placement for the push-up (press-up) exercise. The further employment of the notches 48 across the top of panels 40 in the base level 51 and corresponding lettering 49 across the bottom of panels 40 in the middle level 52 permits the user to perform the push-up (press-up) exercise at an equidistant each time with certainty.

Additionally, the example mat system 10 provides visual and kinesthetic references while the user is performing stationary and/or mobile push-ups (press ups) from the closest to widest hand positions, with both hands on the panels 40 of the base level 51. Further, visual and kinesthetic references on the middle level 52 and top level 53 enable the user to perform staggered stationary and mobile push-ups (press ups) longitudinally and diagonally, either with one hand on a panel 40 of the base level 51 and the other hand on a panel 40 of the middle level 52, or with one hand on a panel 40 of the base level 51 and the other hand on a panel 40 of the top level 53

The use of the example visual and kinesthetic references on the mat system 10 described herein therefore may assist the user in visually placing his/her hand on the device for a push-up (press-up) at the exact position indicated from an instructional sheet, or from an instructor's auditory command, or as desired by the user, for example. The visual and kinesthetic references may also facilitate the placement and alignment of other objects, such as handles, pads for knuckle-ups and/or rotatable handles, for example, to perform a push-up (press-up) exercise. Further, example visual and kinesthetic references allow the user to achieve proper alignment and/or spacing with the mat system 10 on the floor or pinned to a wall. The mat system 10 is also easily portable and can be taken anywhere by the user for exercise.

Figure 6:
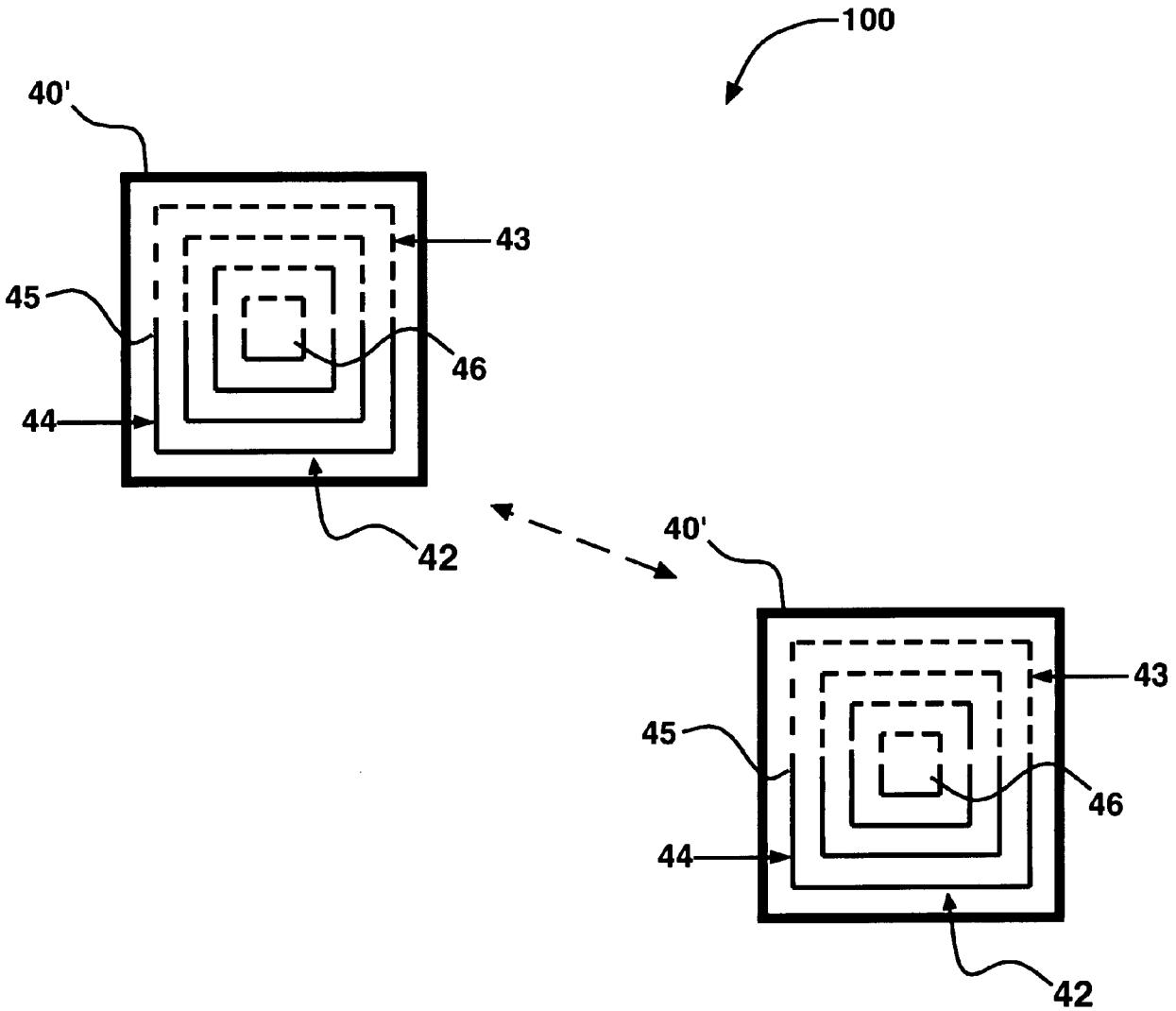
FIG. 6 is a top plan view of an exercise alignment mat system in accordance with another example embodiment.

FIG. 6 is a top plan view of an exercise alignment mat system in accordance with another example embodiment. The example embodiments have heretofore been described with reference to a mat system 10 having a plurality of panels 40 arranged in rows 51, 52, 53. However, an alternative example mat system 100 may consist of a plurality of distinct and separate panels 40'. As shown in FIG. 6, mat system 100 may comprise a plurality of individual panels 40' (two are shown; system 100 may comprise any number of individual panels 40'). The embodiment of FIG. 6 enables the user to position the panels 40' in any desired position on a surface (i.e., floor or wall) so as to perform an exercise.

As panels 40' are similar to panels 40 in FIGS. 1-5, common element numbers are employed in FIG. 6, the differences are noted below. Similar to the embodiment in FIGS. 1-5, each panel 40' has a series as concentric squares (shown generally by arrow 42). Starting with the largest outer square 45, the upper half of each square has a dotted line configuration 43, and a solid line configuration 44 for its lower half. The smallest central square 46 in each panel 40 may optionally have numeric indicia (not shown) therein. Additionally, the grooved notches 48 and lettering 49 may also be provided on the top surface (not shown in the embodiment of FIG. 6).

As previously discussed, the dotted lines 43 of each of the concentric squares 42 provide visual guidance to the user as to where to place their fingertips. The solid lines 44 indicate where the user should place their palm, so as to properly align the hand on a given panel 40' prior to an impending exercise repetition.

In an example, each panel 40' may be composed of a soft material that allows comfort to the user during hand placement, such as EVA foam. The thickness of each panel 40' may be less than that of panels 40 to offer a thinner and lighter product that may facilitate transport. Each panel 40' may also have the same approximate dimensions of the panels 40 in FIGS. 1-5. The underside of panel 40' may have a non-slip material thereon to serve as a friction surface when the panel 40' is resting on a flat surface. The material may be in the form of a rubber pad adhered to the underside of the panel 40' via suitable epoxy or adhesive, for example, or may be a friction adhesive applied to the foam material of the panel 40'.

In one example, if the user wants to position each panel 40' so as to appropriate the positions of the panels 40 in the mat system 10 of FIGS. 1-5 the user may employ a measuring tape to identify the proper dimensions. Because each panel 40' is slightly raised when placed on a surface suitable for push-ups, the spaces between each panel 40' can appropriate or simulate the grooves 21, 23, 33 of the mat system 10.

The mat system 100 offers additional flexibility in that the user is not constrained to the dimensions of the mat system 10 in FIGS. 1-5. The user can arrange each panel 40' in nay desired pattern or location on a flat surface. This permits the user to perform an exercise at any arm's distance/angle (horizontal, longitudinal or diagonal), even beyond the dimensions offered by the mat system 10 of FIGS. 1-5. There is no limitation as to the dimensions the user can create as between multiple panels 40'.

The user may select only a desired number of panels 40' for a given exercise. This eliminates additional panels 40' that are not to be used from the user's view, such as would be the case of the mat system 10. Using singular panels 40' of the mat system 100 may thus further reduce any possibility of error in hand placement.

By utilizing singular panels 40' for an exercise routine, there may be an added benefit in the case where multiple users will be performing the same exercise in turn. By using a specific singular set of panels 40', each person will know of the exact pattern to follow by observing the panels 40' that are placed on the surface during his/her turn. To further assist in developing correct hand orientation, the numerals 47 shown in FIGS. 1-5 may be employed in the small center square 46. Alternatively, several ones of the panels 40' can have a different color to facilitate whether the hand placement is for the left hand or right hand.

The example embodiments being thus described, it will be obvious that the same may be varied in many ways. Although example mat systems 10 and 100 have been described for use in performing various upper body exercises, the mat systems 10, 100 may assist with alignment where users are performing various lower body exercises, such as squats, lunges, toe raises, etc. Such variations are not to be regarded as departure from the example embodiments, and all such modifications as would be obvious to one skilled in the art are intended to be included herein.

What is claimed is:

1. An exercise alignment mat system, comprising:

a single-layer mat of a homogenous material and of a generally flat structure having a top surface, bottom surface and a thickness, a major longitudinal axis and a minor longitudinal axis orthogonal to the major longitudinal axis, a central groove formed in the top surface and having a first width, the central groove extending along the minor axis so as to bisect the mat, a first set of equally spaced grooves formed in the top surface and having a second width less than the first width, the first set of grooves extending along the minor axis parallel to the central groove, a second set of equally spaced grooves formed in the top surface and equal in width to the first set of grooves, the second set of grooves extending along the major axis orthogonal to the central groove, wherein intersections of the central groove, first set and second set of grooves defines a plurality of equal sized panels, each panel including a set of concentric squares indicia thereon to facilitate hand placements for exercise, each set of squares further defined by a plurality of squares that reduce in width toward the center of its corresponding panel so as to be concentrically nested within outer larger-width squares of its panel.

2. The system of claim 1, wherein each panel includes a sequential number centered within a smallest of the concentric squares thereon.

3. The system of claim 1, wherein the panels are arranged in three rows along the minor axis, and each panel on the mat is numbered in a sequential order, the number centered within a smallest of the concentric squares thereon and representing a visual reference location for a hand placement for a given exercise.

4. The system of claim 1, wherein the upper half of each square in the concentric squares has a dotted line configuration for fingertip placement and the lower half has a solid line configuration for palm placement.

5. The system of claim 1, further comprising:

a plurality of grooved notches extending along the major axis of the mat across the top of a row of panels adjoining one of the second set of grooves, the grooved notches providing a tactile reference for a finger tip of a user's middle finger to facilitate hand placements for exercise.

6. The system of claim 1, further comprising:

a plurality of lettering sequences extending along the major axis of the mat across the bottom of a row of panels adjoining one of the second set of grooves, the sequences repeating in each panel and providing a visual reference for a finger tip of a user's middle finger to facilitate hand placements for exercise.

7. The system of claim 1, further comprising:

a first pair of spaced, upwardly angled lines extending from a largest square of the concentric squares within a first panel that abuts the central groove, and a second pair of spaced, upwardly angled lines extending from a largest square of the concentric squares within a second panel that abuts the central groove, the second panel adjoining the first panel, the second pair angled in mirror image relation to the first pair, the first and second pairs of angled lines providing a visual reference for index finger placement of each hand of a user for exercise.

8. The system of claim 1, wherein the defined panels with concentric squares therein facilitate performing one or more of stationary, mobile horizontal, staggered, stationary staggered diagonal, stationary staggered longitudinal mobile, and staggered diagonal push-up exercises.

9. An exercise alignment mat system, comprising:

a mat of a generally flat structure having a top surface, bottom surface and a thickness, a major longitudinal axis and a minor longitudinal axis orthogonal to the major longitudinal axis, a plurality of spaced grooves formed in the top surface along both the major and minor axes so as to define a plurality of equal sized panels on the mat, each panel including a set of concentric squares indicia thereon, each set of concentric squares further defined by a plurality of squares that reduce in width toward the center of its corresponding panel so as to be concentrically nested within outer larger-width squares of its panel, in which an upper half of each square in the set of concentric squares has a dotted line configuration for fingertip placement, and a lower half of each square has a solid line configuration for palm placement.

10. The system of claim 9, wherein each panel on the mat is numbered in a sequential order, the number centered within a smallest of the concentric squares thereon and representing a visual reference location for a hand placement for a given exercise.

11. The system of claim 9, further comprising:

a plurality of grooved notches extending along the major axis of the mat across the top of a row of panels for providing a tactile reference for a finger tip of a user's middle finger to facilitate hand placements for exercise.

12. The system of claim 9, further comprising:

a plurality of lettering sequences extending along the major axis of the mat across the bottom of a row of panels, the sequences repeating in each panel and providing a visual reference for a finger tip of a user's middle finger to facilitate hand placements for exercise.

13. The system of claim 9, further comprising:

a first pair of spaced, upwardly angled lines extending from a largest square of the concentric squares within a first panel, and a second pair of spaced, upwardly angled lines extending from a largest square of the concentric squares within a second panel that adjoins the first panel, the second pair angled in mirror image relation to the first pair, the first and second pairs of angled lines providing a visual reference for index finger placement of each hand of a user for exercise.

14. An exercise alignment mat system, comprising:

a mat of a generally flat structure having a top surface, bottom surface and a thickness, a major longitudinal axis and a minor longitudinal axis orthogonal to the major longitudinal axis, a plurality of spaced grooves formed in the top surface along both the major and minor axes so as to define a plurality of equal-sized panels arranged in rows on the mat, a plurality of grooved notches extending along the major axis of the mat across the top of a row of panels for providing a tactile reference for a finger tip of a user's middle finger to facilitate hand placements for exercise.

15. The system of claim 14, wherein each panel on the mat is numbered in a sequential order, the number centered on each panel and representing a visual reference location for a hand placement for a given exercise.

16. The system of claim 14, wherein each panel includes a set of concentric squares indicia thereon for fingertip and palm placement.

17. The system of claim 14, further comprising:

a plurality of lettering sequences repeating in each panel of a given row to provide a visual reference for a finger tip of a user's middle finger to facilitate hand placements for exercise.

18. The system of claim 14, further comprising:

a first pair of spaced, upwardly angled lines extending from a largest square of the concentric squares within a first panel, and a second pair of spaced, upwardly angled lines extending from a largest square of the concentric squares within a second panel that adjoins the first panel, the second pair angled in mirror image relation to the first pair, the first and second pairs of angled lines providing a visual reference for index finger placement of each hand of a user for exercise.

19. An exercise alignment mat system, comprising:

a mat of a generally flat structure having a top surface, bottom surface and a thickness, a major longitudinal axis and a minor longitudinal axis orthogonal to the major longitudinal axis, a plurality of spaced grooves formed in the top surface along both the major and minor axes so as to define a plurality of equal-sized panels arranged in rows on the mat, a plurality of lettering sequences repeating in each panel of one of the rows to provide a visual reference for a finger tip of a user's middle finger to facilitate hand placements for exercise, and a plurality of grooved notches extending along the major axis of the mat across the top of a row of panels for providing a tactile reference for a finger tip of a user's middle finger to facilitate hand placements for exercise.

20. The system of claim 19, wherein each panel on the mat is numbered in a sequential order, the number centered on each panel and representing a visual reference location for a hand placement for a given exercise.

21. The system of claim 19, wherein each panel includes a set of concentric squares indicia thereon for fingertip and palm placement.

22. The system of claim 19, further comprising:

a first pair of spaced, upwardly angled lines extending from a largest square of the concentric squares within a first panel, and a second pair of spaced, upwardly angled lines extending from a largest square of the concentric squares within a second panel that adjoins the first panel, the second pair angled in mirror image relation to the first pair, the first and second pairs of angled lines providing a visual reference for index finger placement of each hand of a user for exercise.

23. An exercise alignment mat system, comprising:

a mat of a generally flat structure having a top surface, bottom surface and a thickness, a major longitudinal axis and a minor longitudinal axis orthogonal to the major longitudinal axis, a plurality of spaced grooves formed in the top surface along both the major and minor axes so as to define a plurality of equal sized panels arranged in rows on the mat, each panel including a set of concentric squares indicia thereon, a first pair of spaced, upwardly angled lines extending from a largest square of the concentric squares within a first panel, and a second pair of spaced, upwardly angled lines extending from a largest square of the concentric squares within a second panel that adjoins the first panel, the second pair angled in mirror image relation to the first pair, the concentric squares and first and second pairs of angled lines providing a visual reference for index finger placement of each hand of a user for exercise.

24. The system of claim 23, further comprising:

a plurality of lettering sequences repeating in each panel of one of the rows to provide a visual reference for a finger tip of a user's middle finger to facilitate hand placements for exercise.

25. The system of claim 23, wherein each panel on the mat is numbered in a sequential order, the number centered on each panel within a smallest of the concentric squares and representing a visual reference location for a hand placement for a given exercise.

26. The system of claim 23, further comprising:

a plurality of grooved notches extending along the major axis of the mat across the top of one row of panels for providing a tactile reference for a finger tip of a user's middle finger to facilitate hand placements for exercise.

27. An exercise alignment mat system, comprising:

a single-layer mat of a homogenous material and of a generally flat structure having a top surface, bottom surface and thickness on which is imprinted a plurality of separate and generally square panels, wherein each panel includes a set of concentric squares indicia thereon, in which an upper half of each square of the set of concentric squares has a dotted line configuration for fingertip placement, and a lower half of each square of the set has a solid line configuration for palm placement.

* * * * *